US006001495A

United States Patent [19]

Bristow et al.

[11] Patent Number: 6,001,495

[45] Date of Patent: Dec. 14, 1999

[54] HIGH MODULUS, LOW-COST, WELDABLE, CASTABLE TITANIUM ALLOY AND ARTICLES THEREOF

[75] Inventors: Bryan Bristow, Albany; Chris Nordlund, Salem; Steven H. Reichman, Portland, all of Oreg.

[73] Assignee: Oregon Metallurgical Corporation, Albany, Oreg.

[21] Appl. No.: 08/935,802

[22] Filed: Aug. 4, 1997

[51] Int. Cl.[6] ..... C22C 14/00; A63B 53/04

[52] U.S. Cl. ..... 428/660; 420/418; 75/612; 473/349

[58] Field of Search ..... 428/636, 660; 420/418, 419, 420; 75/611, 612; 473/349

[56] References Cited

U.S. PATENT DOCUMENTS

| | | | |
|---|---|---|---|
| 2,575,962 | 11/1951 | Jaffee et al. | 420/418 |
| 2,798,806 | 7/1957 | Jaffee et al. | 420/418 |
| 2,893,864 | 7/1959 | Harris et al. | 420/418 |
| 4,944,914 | 7/1990 | Ogawa et al. | 420/418 |
| 5,219,521 | 6/1993 | Adams et al. | 320/418 |
| 5,346,217 | 9/1994 | Tsuchiya et al. | 273/167 R |
| 5,358,686 | 10/1994 | Parris et al. | 420/418 |
| 5,406,202 | 4/1995 | Igarashi | 273/169 |
| 5,464,216 | 11/1995 | Hoshi et al. | 273/167 R |
| 5,759,484 | 6/1998 | Kashii et al. | 420/420 |

FOREIGN PATENT DOCUMENTS

| | | | |
|---|---|---|---|
| 1142445 | 1/1963 | Germany | 420/420 |
| 4-358036 | 12/1992 | Japan | C22C 14/00 |
| 248229 | 7/1969 | U.S.S.R. | 420/420 |
| 443090 | 9/1974 | U.S.S.R. | 420/419 |

*Primary Examiner*—John J. Zimmerman
*Attorney, Agent, or Firm*—Townsend and Townsend and Crew LLP

[57] ABSTRACT

An improved high-modulus, low-cost, castable, weldable titanium alloy and a process for making such an alloy is provided. In general, titanium is alloyed with about 0.75 weight percent iron and about 8 weight percent aluminum to result in an alloy with a modulus of over $21\times10^6$ psi. This modulus is above the modulus for conventional castable titanium alloys, such as the commercially-available castable titanium alloy containing 6 weight percent aluminum and 4 weight percent vanadium.

Applications for this alloy include golf club heads, which can be fabricated by casting a golf club head body from the above alloy and welding a sole plate onto the cast golf club head body. This provides a golf club head with superior energy transfer characteristics for hitting a golf ball.

13 Claims, 3 Drawing Sheets

Modulus Test Matrix for Titanium Alloys

(1 x $10^6$ psi)

| WT. % Al \ WT. % Fe | 0.60 | 0.70 | 0.80 | 0.90 | 1.00 |
|---|---|---|---|---|---|
| 7.25 | 19.4 | 20.4 | 21.3 | 19.3 | N/A |
| 7.40 | 20.1 | 22.5 | 19.5 | 20.4 | N/A |
| 7.65 | 19.8 | 22.8 | 21.5 | 20.5 | 21.2 |
| 7.90 | 20.3 | 18.9 | 19.7 | 22.4 | 19.1 |
| 8.15 | N/A | N/A | 21.2 | 19.6 | 19.6 |

| Alloy (weight %) | Modulus of Elasticity ($1 \times 10^6$ psi) |
|---|---|
| Commercially Pure Ti | 14.9 |
| Ti-5Al-2.5Sn | 15.9 |
| Ti-8Al-1Mo-1V | 17.0 |
| Ti-6Al-4V | 16.5 |
| Ti-6Al-2Sn-4Zr-2Mo | 16.5 |
| Ti-6Al-2Sn-4Zr-6Mo | 16.5 |
| Ti-3Al-2.5V | 13.2 |
| Ti-6Al-7Nb | 15.2 |
| Ti-5Al-2Sn-4Mo-2Zr-4Cr | 15.9 |

Figure 1

Prior Art

Modulus Test Matrix for Titanium Alloys (1 x $10^6$ psi)

| WT. % Al \ WT. % Fe | 0.60 | 0.70 | 0.80 | 0.90 | 1.00 |
|---|---|---|---|---|---|
| 7.25 | 19.4 | 20.4 | 21.3 | 19.3 | N/A |
| 7.40 | 20.1 | 22.5 | 19.5 | 20.4 | N/A |
| 7.65 | 19.8 | 22.8 | 21.5 | 20.5 | 21.2 |
| 7.90 | 20.3 | 18.9 | 19.7 | 22.4 | 19.1 |
| 8.15 | N/A | N/A | 21.2 | 19.6 | 19.6 |

Figure 2

HIGH MODULUS, LOW-COST, WELDABLE, CASTABLE TITANIUM ALLOY AND ARTICLES THEREOF

BACKGROUND OF THE INVENTION

The present invention relates to titanium alloys and products made from titanium alloys, and more particularly to a castable, weldable, high-modulus titanium alloy and associated products. One embodiment of the present invention is particularly useful for manufacturing golf club heads.

Titanium alloys are used in a wide range of products from aerospace components to bicycle parts. Titanium parts can be fabricated using several different techniques, such as casting, forging, milling, or powder metallurgy. The optimal alloy composition depends on the intended product and fabrication technique. For example, ductility may be an important characteristic for a mill product made by a rolling process, while melt fluidity may be more important when producing cast products. Multiple types of fabrication processes, such as welding to a cast titanium alloy part, place additional constraints on the alloy composition. In such an instance, the alloy must have good welding properties, as well as good casting properties. Additionally, it may be desirable to improve a material parameter of the alloy, such as modulus, hardness, strength, or toughness, based on the intended use of the part made from that alloy.

In some instances, an alloy exhibiting good material parameters for an intended purpose may be incompatible with a fabrication process. For example, it is desirable that a golf club head have a high modulus, so that the energy of the swung golf club is efficiently transferred to the golf ball when it is hit. A titanium alloy containing 8 weight percent aluminum, 1 weight percent vanadium, and 1 weight percent molybdenum (Ti 8-1-1) has a modulus of about $17\times10^6$ psi, which is appropriate for use in a golf club head. However, golf club heads are often cast, and Ti 8-1-1 does not exhibit good casting properties. A titanium alloy containing 6 weight percent aluminum and 4 weight percent vanadium (Ti 6-4) has better casting properties, but a lower modulus ($16.5\times10^6$ psi), making it a less attractive material for use in a golf club head. Additionally, vanadium is an expensive alloying element, accounting for approximately 10% of the material cost of the Ti 6-4 alloy at current market prices, making this alloy even less attractive for high-volume use in a recreational product, such as a golf club head.

Therefore, a titanium alloy with the modulus of Ti 8-1-1 and the castability of Ti 6-4 would be desirable. It would be further desirable that this alloy contain less expensive alloying components than present alloys. It is also desirable that such an alloy exhibit good weldability.

SUMMARY OF THE INVENTION

The present invention provides an improved high-modulus, low-cost, castable, weldable titanium alloy, a process for making such an alloy, and parts fabricated from such an alloy. In a specific embodiment, titanium is alloyed with 0.75 weight percent iron and 8 weight percent aluminum to result in an alloy with a modulus of over $21\times10^6$ psi.

In another embodiment of the invention, golf club heads were fabricated by casting a golf club head body from the above alloy and welding a sole plate onto the cast golf club head body. This results in a golf club head with superior energy transfer characteristics for hitting a golf ball.

These and other embodiments of the present invention, as well as its advantages and features are described in more detail in conjunction with the text below and attached figures.

BRIEF DESCRIPTION OF THE DRAWINGS

FIG. 1 is a table showing the modulus of elasticity for various titanium alloys, and for commercially pure titanium;

FIG. 2 is a table showing the modulus for titanium alloys according to the present invention;

DESCRIPTION OF THE PREFERRED EMBODIMENT

Figure 3:
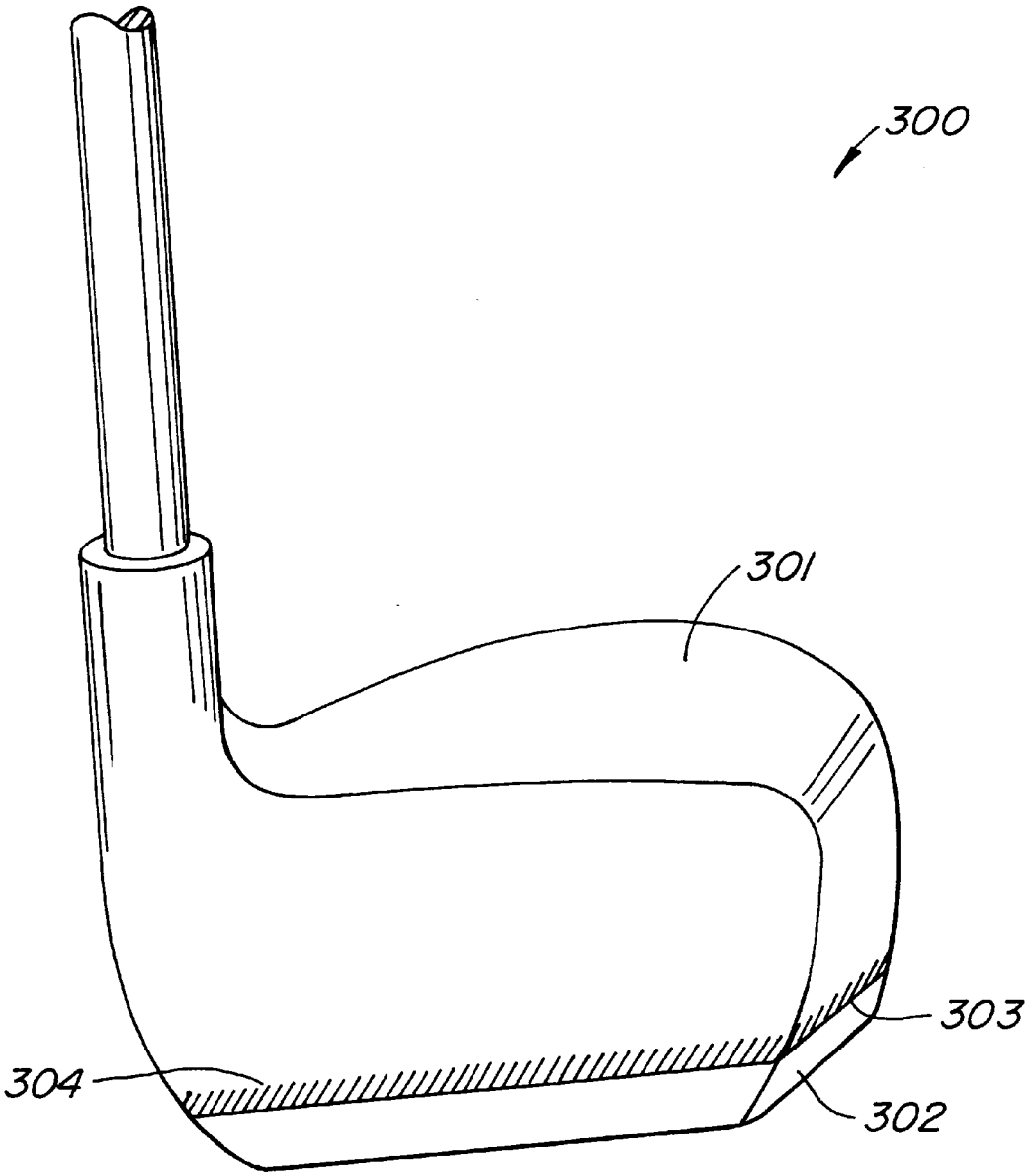
FIG. 3 is a simplified perspective view of a portion of a golf club, according to an embodiment of the present invention.

A titanium alloy according to one embodiment of this invention is shown to have a more superior modulus of elasticity than predicted, while retaining good casting and welding properties. This modulus was obtained by substituting iron as an alloying component to replace the relatively more expensive alloying elements of molybdenum and vanadium. This alloy is an attractive material for recreational-grade products, such as golf club heads.

I. Alloy Composition and Properties

As discussed above, a commercially-available titanium alloy containing 8 weight percent aluminum, 1 weight percent vanadium, and 1 weight percent molybdenum (Ti 8-1-1) has a modulus of $17\times10^6$ psi, according to the published literature. This modulus is higher than the modulus for several other production alloys, including commercially pure (CP) titanium, as shown in FIG. 1, and therefore is desirable in applications requiring a high modulus. The molybdenum equivalency equation may be used to predict an appropriate amount of iron to use in place of molybdenum and vanadium alloying elements to produce an alloy with a similar modulus. The molybdenum equivalency equation is given below:

$$[Mo]_{eq.}=[Mo]+[Va]/1.5+2.5[Fe]$$

This equation applied to Ti 8-1-1 (which contains 0.1 weight percent iron) results in a molybdenum equivalency of 1.92, and predicts that substituting 0.65 weight percent iron for the molybdenum and vanadium (for a total iron concentration of 0.75 weight percent) will result in a modulus of approximately $17\times10^6$ psi. An ingot of titanium alloy containing 8 weight percent aluminum and 0.75 weight percent iron was produced according to the methods described below. This ingot was tested by cutting bars for tensile tests and for Charpy impact tests. Nine tensile samples were tested, and surprisingly resulted in an average modulus of elasticity of $21.43\times10^6$ psi for this alloy, with a standard deviation of 0.76. This modulus is much higher than predicted or expected. A summary of the mechanical properties of this alloy is provided in Table 1, below:

TABLE 1

| Modulus | Yield Strength | Ultimate Tensile Strength | Elongation | Reduction of Area | Weld Test | Charpy Impact Test |
|---|---|---|---|---|---|---|

TABLE 1-continued

| Alloy | $1 \times 10^6$ psi | Ksi | Ksi | % | % | % UTS | Ft-lbs |
|---|---|---|---|---|---|---|---|
| Ti 8Al—0.75Fe | 21.43 | 115.3 | 129.6 | 6.3 | 13.4 | 76 | 17.7 |

Additional alloy compositions were prepared to investigate the unexpectedly high modulus resulting from the iron substitution in the above sample. A matrix experiment was designed to determine the sensitivity of the modulus of titanium alloy composition to iron substitution, and to see if an even higher modulus might be obtained. The results of this matrix experiment are summarized in FIG. 2. As seen from these results, moduli superior to Ti 8-1-1 are obtained over a range of titanium alloys containing at least between 7.25 and 8.15 weight percent aluminum and between 0.6 and 1 weight percent iron. The addition of aluminum lightens the specific gravity of the alloy and hardens the alloy by substitution. The aluminum concentration can be increased to at least 8.50 weight percent, after which point a brittle phase can result, which is generally undesirable for use in products that must withstand impacts. Similarly, the aluminum concentration can be decreased to at least 7 weight percent, after which point the titanium alloy loses some of the beneficial hardening properties of the aluminum addition. It was further determined that adding oxygen, which occupies an interstitial position in the alloy, in amounts between 0.10 to 0.35 weight percent improves the strength of the alloys, with about 0.20 weight percent preferred. Below about 0.10 weight percent oxygen, the alloy becomes weak, while above about 0.35 weight percent oxygen the alloy becomes brittle.

One intended use for this alloy family is in the manufacture of golf clubs, such as so called metal woods. FIG. 3 shows an embodiment of the present invention as a golf club 300 with a cast golf club head 301 and a sole plate 302. The sole plate can be welded to the cast golf club head at weld 303, attached to the cast golf club head using other means, such as rivets. The sole plate can be the same alloy, or a different alloy, from the golf club head. For example, it may be desirable to make the sole plate out of an alloy that has higher hardness and wear resistance, such as a titanium alloy containing 15 weight percent vanadium, 3 weight percent aluminum, 3 weight percent tin, and 3 weight percent chrome, or to make the plate out of commercially pure (CP) titanium. Therefore, weldability of the cast golf club head is important and welding tests were performed on alloys according to the present invention.

Samples of the alloy were manufactured and destructively tested on a tensile tester. The broken tensile test samples were fusion welded (i.e. no filler metal was used) together and re-tested on the tensile tester. This typically resulted in a tensile sample that failed at a lower ultimate tensile strength (UTS) than the original sample. The weldability was evaluated by comparing the UTS of the welded sample as a percent of the UTS of the original, as-cast sample. A titanium alloy containing 8 weight percent aluminum and 0.75 weight percent iron exhibited a weld strength of 71% of the original UTS of the as-cast samples. This weld strength is considered very good for a casting-type titanium alloy, and comparable to a commercial castable titanium alloy containing 6 weight percent aluminum and 4 weight percent vanadium (Ti 6-4).

The appearance of the weld joint between the sole plate and the cast head was evaluated using different alloy welding rods. Titanium alloys often oxidize when heated in air. Therefore, it is important to control the welding environment to exclude air. This can be done by welding in a vacuum, such as with an electronic beam, or by welding under a non-reactive gas blanket, such as with a tungsten-inert-gas (TIG) welding process.

Commercially pure titanium welding rods left a shadow 304 in the cast head above the weld joint when used in a TIG welding process to attach a sole plate to the cast head. It is believed that the weld puddle preferentially dissolved aluminum from the cast alloy portion of the joint, thereby depleting the cast alloy of aluminum in this region. Aluminum serves to lighten the appearance of the titanium alloy; therefore, depleting the cast alloy weld zone of aluminum darkened this region. A Ti 6-4 welding rod has nominally the same aluminum content as the present family of cast alloys, and was found suitable for producing a shadow-free weld between a sole plate and a cast head.

II. Exemplary Processes for Fabricating Alloyed Ingots

One well-known technique for producing titanium alloys is the vacuum arc remelt process. In this process, titanium stock, such as sponge or machining turnings, is mixed with the alloying components, such as aluminum or iron powder. Titanium dioxide may be added to the mixture, if desired, to provide a source of oxygen, which is used as a hardening agent. The mixture of the titanium stock and alloying components is pressed into a compact known as a "brick. " Each brick may weigh 100–200 pounds, for example. The pressed bricks look like solid metal, and are welded together to form a consumable electrode weighing up to several thousand pounds. This electrode is suspended in a vacuum furnace above a water-cooled copper crucible. The consumable electrode is lowered into the crucible to strike an arc, which heats the consumable electrode to the melting point at the location of the arc. This causes molten metal to puddle in the water-cooled crucible, where it solidifies. The consumable electrode is raised, typically with automatic equipment, to maintain a proper arc length and a molten puddle on top of the solidified alloy in the crucible. The puddle accumulates and solidifies until a titanium alloy ingot having the composition of the composite electrode fills the crucible.

The ingot is removed from the crucible and may be used as-is or remelted as a consumable ingot again, to further mix the alloy constituents and remove impurities through the vacuum arc remelt process. Eventually, the ingots are processed into casting electrodes or other raw stock, suitable for component fabrication processes. For example, the nominally 36-inch diameter ingot can be forged into nominally 6-inch or 8-inch casting electrodes.

Another process that can be used to produce suitable titanium alloys is cold hearth refining. In cold hearth refining, the raw, unpurified titanium source, for example, titanium scrap, titanium sponge, or other titanium-containing material, is introduced into a furnace. Typically, the furnace operates in a vacuum or a controlled inert atmosphere. The titanium is then melted, for example, using energy sources such as electron beam guns or plasma torches. As the molten titanium passes through the furnace, some undesirable impurities evaporate or sublimate, and are removed by a vacuum pump or exhaust system, while other impurities sink, thereby purifying the melt.

Cold hearth refining is referred to as such because of the use of a cold hearth. That is, during operation of the furnace, the hearth is cooled, solidifying the titanium that is in contact with the hearth surface. The solidified titanium forms a layer between the hearth and the melt, essentially forming a hearth lining of the same composition as the melt, thus reducing contamination of the melt from the hearth, and protecting the hearth from the melt. This hearth lining is commonly known as a skull.

In a typical cold hearth furnace used for the production of titanium alloys, the hearth of the furnace is fabricated from copper. The copper hearth has interior channels that carry water to cool the copper and prevent it from melting. Heating the melt from its upper (free) surface allows the heat to flow from the center of the melt to the hearth, creating a thermal gradient that further supports formation of a suitable skull.

In the furnace, titanium stock is added from a hopper or conveyer at one end of the furnace, melted, and flows generally from that end of the furnace to another end of the furnace. Alloying components may be added along with the titanium stock, or from separate hoppers. The flow of the melt serves to mix the alloying components with the titanium. The well-mixed melt then flows through openings in the bottom of the furnace where it is cast into desired shapes using one or more molds of various configurations, such as ingots or casting electrodes.

III. An Exemplary Process for Producing Cast Parts

Parts may be cast from the alloy supplied as casting electrode stock by melting off a suitable portion of the electrode, with an electric arc in a vacuum, for example, to form a "pour." Each electrode may weigh several hundred pounds. The size of the pour is chosen according to the number of parts to be cast from that pour. For example, if one pound of electrode stock is required to produce each cast part, a fabrication run consisting of 30 parts would require 30 pounds of electrode stock to be melted to form the pour. The molten electrode stock would be poured into the 30 casting molds, where it would cool into the cast part. Investment casting is a preferred casting method for forming some parts, such as golf club heads, because investment casting provides a good surface finish, good dimensional control, and low scrap and secondary machining compared to some other casting processes.

While the above is a complete description of specific embodiments of the present invention, various modifications, variations, and alternatives may be employed. For example, a product could be forged or machined from an alloy according to the present invention, or cast using other processes, such as cope-and-drag casting. Other variations will be apparent to persons of skill in the art. These equivalents and alternatives are intended to be included within the scope of the present invention. Therefore, the scope of this invention should not be limited to the embodiments described, and should instead be defined by the following claims.

What is claimed is:

1. A titanium alloy consisting essentially of:

about 7.25 to about 8.50 weight percent aluminum;

about 0.10 to about 0.35 weight percent oxygen; and about 0.60 to about 1.00 weight percent iron, the balance being essentially titanium and incidental impurities.

2. A titanium alloy consisting essentially of:

about 7.6 to about 7.9 weight percent aluminum; and about 0.65 to about 0.75 weight percent iron the balance being titanium and incidental impurities.

3. The alloy of claim 1 wherein said titanium alloy has a modulus of elasticity above about $17\times10^6$ psi.

4. The alloy of claim 3 wherein said titanium alloy has a modulus of elasticity above about $18.8\times10^6$ psi.

5. A titanium alloy consisting essentially of:

about 7.6 to about 7.9 weight percent aluminum;

about 0.65 to about 0.75 weight percent iron; and about 0.10 to about 0.35 weight percent oxygen.

6. A cast titanium alloy golf club head consisting essentially of about 7.25 to about 8.15 weight percent aluminum, about 0.60 to about 1.0 weight percent iron, and about 0.1 to about 0.35 weight percent oxygen, the balance being titanium and incidental impurities.

7. A process for making a castable, molybdenum-substituted titanium alloy comprising:

a) providing a means for melting titanium;

b) melting a titanium alloy stock in said means for melting titanium;

c) adding between about 7.25 to about 8.15 weight percent aluminum to said titanium stock; and d) adding between about 0.10 to about 0.35 weight percent oxygen to said titanium stock; and e) adding between about 0.60 to about 1.0 weight percent iron to said titanium stock wherein no other alloying elements are intentionally added to said titanium stock, and said molybdenum-substituted titanium alloy has a modulus of elasticity above about 17E16 psi.

8. The process of claim 7 wherein said means for melting titanium is a vacuum arc remelt furnace.

9. The process of claim 7 wherein said means for melting titanium is a cold hearth furnace.

10. The process of claim 7 wherein said steps (c), (d), and (e) are performed substantially concurrently.

11. A high-modulus, cast body of an aluminum-and-iron-modified titanium alloy, said alloy consisting essentially of about 7.6–7.9 weight percent aluminum, about 0.10–0.35 weight percent oxygen, and about 0.65–0.75 weight percent iron, the balance being essentially titanium and incidental impurities.

12. The cast body of claim 11 further comprising a second body, said second body being welded to the cast body to form a composite body.

13. The composite body of claim 12 wherein said second body is welded to the cast body using a welding material comprising between about 6 weight percent to about 8 weight percent aluminum.

* * * * *